United States Patent [19]

Magee et al.

[11] Patent Number: 4,691,109

[45] Date of Patent: Sep. 1, 1987

[54] APPARATUS AND METHOD FOR PRODUCING IONS

[75] Inventors: Charles W. Magee, West Windsor Township, Mercer County; Lori R. Hewitt, Lawrence Township, Mercer County, both of N.J.

[73] Assignee: RCA Corporation, Princeton, N.J.

[21] Appl. No.: 823,258

[22] Filed: Jan. 28, 1986

[51] Int. Cl.[4] ..... H01J 27/00

[52] U.S. Cl. ..... 250/426; 250/423 R; 315/111.81

[58] Field of Search ..... 250/423 R, 426; 313/231.41, 642, 643, 362.1; 315/111.81

[56] References Cited

U.S. PATENT DOCUMENTS

| | | | |
|---|---|---|---|
| 3,234,421 | 2/1966 | Reiling | 313/43 |
| 3,408,283 | 10/1968 | Chopra et al. | 250/426 |
| 3,409,529 | 11/1968 | Chopra et al. | 250/426 |
| 3,448,333 | 6/1969 | Arkless et al. | 315/111 |
| 3,513,351 | 5/1970 | Kelly | 250/426 |

OTHER PUBLICATIONS

"Ion Beams", by R. G. Wilson and G. R. Brewer, published by J. Wiley and Son, 1973, pp. 48–58 and 61–66.

*Primary Examiner*—Bruce C. Anderson

*Attorney, Agent, or Firm*—Joseph S. Tripoli; Donald S. Cohen

[57] ABSTRACT

A source of a beam of ions includes in a housing a cathode filament, an anode spaced from the cathode and housing an ion emission opening therethrough and an intermediate electrode between the cathode and anode and having an opening therethrough in alignment with the opening in the anode. An inlet opening extends through the housing into the space between the anode and the intermediate electrode to admit a flow of starting gas and the gas to be ionized into the housing. An outlet opening is through the housing adjacent the cathode and a pump is connected to the outlet opening. In the operation of the ion source a flow of the starting gas is provided through the housing and over the cathode to initiate the discharge. Then the gas to be ionized is admitted into the housing. Some of the gas is ionized to generate the desired ions and the rest of the gas is drawn out of the housing to remove impurities generated at the cathode and thereby increase the lifetime of the cathode. Once the ionizing gas is admitted into the housing, the flow of the starting gas is stopped.

8 Claims, 1 Drawing Figure

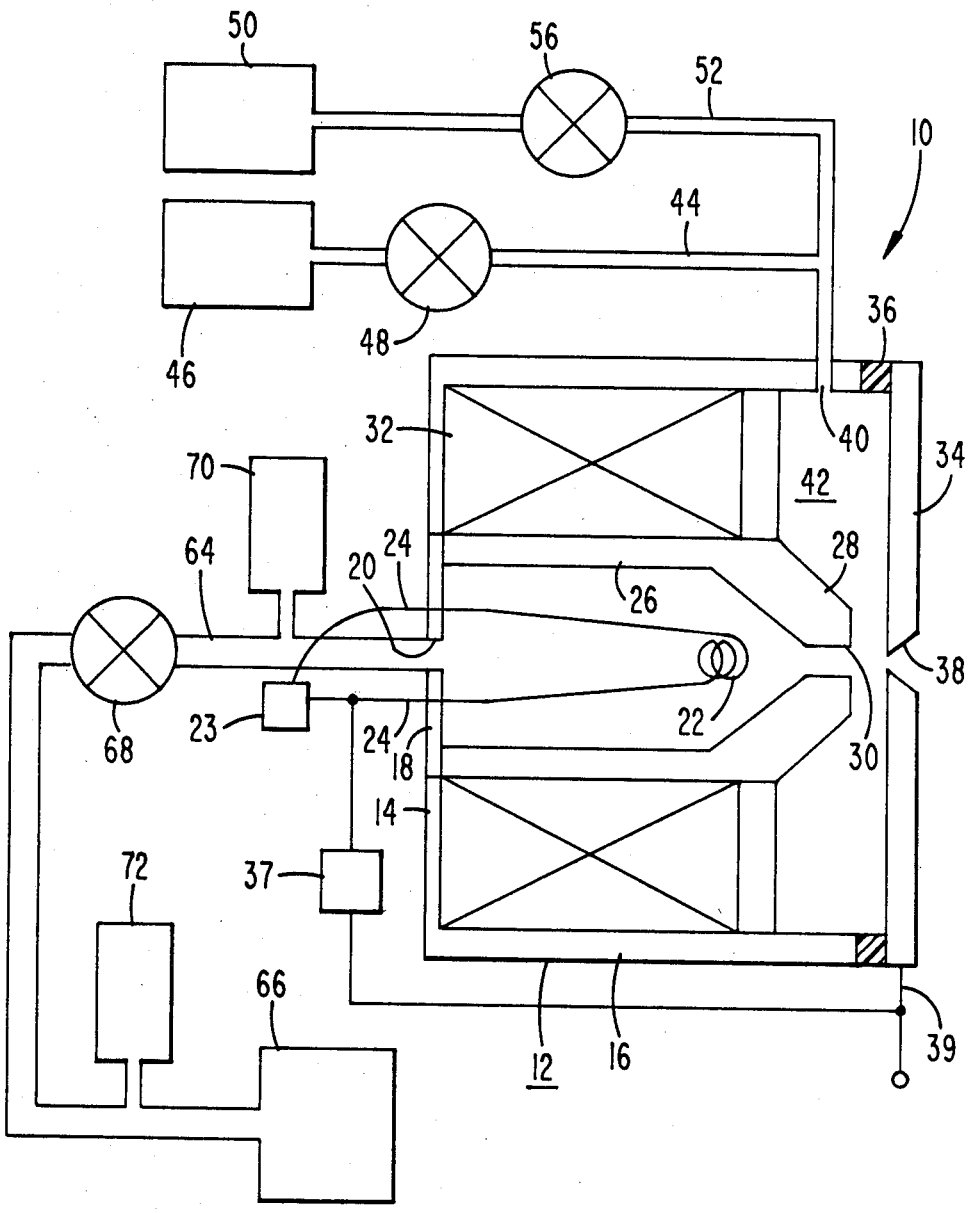
50
56
52
10
44
36
46
48
40
32
34
70
42
64
24
20
28
26
38
68
23
22
24
18
30
14
72
37
66
39
12
16

APPARATUS AND METHOD FOR PRODUCING IONS

The present invention relates to an apparatus and method for producing a beam of ions, and more particularly, to a hot filament apparatus having a longer operating lifetime. Of interest is copending application U.S. Ser. No. 823,257 filed concurrently herewith and is assigned to the assignee of the present application.

BACKGROUND OF THE INVENTION

Beams of ions have found increasing use in the fabrication and diagnosis of many types of devices, particularly in the field of microelectronic devices and circuits. Some applications for ion beams are described in ION BEAMS by R. G. Wilson and G. R. Brewer, published by John Wiley and Son, 1973 in Chapter 4, pages 261–398. An important part of an ion beam system is the ion source. Wilson et al. in Chapter 2, pages 11–128, describe various types of ion beam sources. One type of ion beam source commonly used is a hot filament cathode source described on pages 48–58 in Wilson et al., and more particularly, a plasmatron source described on pages 61–66. A plasmatron, in general, includes a filament type cathode, an intermediate electrode in front of the cathode and an anode in front of the intermediate electrode. The intermediate electrode and the anode have aligned openings therethrough which allow the emission of the ions. A gas to be ionized is emitted into the system, generally between the anode and the intermediate electrode and flows to the filament cathode.

In the operation of the plasmatron, the filament cathode is heated and an arc discharge, a plasma, is created between the heated cathode and the anode. This generates electrons which are accelerated from the cathode to the aode through the gas to be ionized. The plasma is constricted by the intermediate electrode which is at a potential intermediate the cathode and anode. This creates a plasma bubble bounded by a charge double layer that focuses the electron from the plasma on the cathode side to the region in front of the ion extraction aperture. In a unoplasmatron, the ions are extracted from the bubble. A duoplasmatron includes an electromagnet around the plasma which creates a magnetic field. The magnetic field confines the electrons so as to limit intense ionization to a small region around the anode aperture. Extraction electrodes are generally provided in front of the anode to extract the ions.

This type of ion beam source has been found to have several problems. A major problem is that the hot filament cathode does not have a very long life when operating with helium as the discharge gas, generally only about 50 hours. Another problem which has arisen is the ability to start the operation of the device.

SUMMARY OF THE INVENTION

An ion beam source includes a housing having therein a filament cathode and an anode spaced from the cathode. The cathode has an opening therethrough. The housing also includes means for emitting a gas to be ionized and a starting gas into the housing between the anode and the cathode and an opening therethrough on the side of the cathode away from the anode. There is also means for causing a flow of the ionizing gas over the cathode and out of the housing through the opening. In the operation of the ion beam source, a flow of the starting gas is provided through the housing and across the cathode filament to initiate the discharge. Then a flow of the ionizing gas, such as pure helium, is provided through the housing and across the cathode filament to generate the desired ions and to remove any impurities which may be formed at the cathode filament so as to increase the operating life of the filament.

BRIEF DESCRIPTION OF THE DRAWING

The FIGURE of the drawing is a schematic view of a form of an ion beam source which includes the present invention.

DETAILED DESCRIPTION OF PREFERRED EMBODIMENT

The ion source, generally designated as 10, shown in the FIGURE of the drawing, is a form of a duoplasmatron. Ion source 10 includes a housing 12 having a back wall 14 and an outer wall 16. The back wall 14 includes a filament support plate 18 having an outlet opening 20 therethrough. A cathode filament 22 in the form of a coil, is within the housing 12 and is mounted on the support plate 18 with the longitudinal axis of the filament coil 22 being substantially perpendicular to the back wall 14. The filament 22 has terminals 24 extending through the support plate 18 to permit the filament 22 to be connected to a source of current 23. The cathode filament 22 is made of a material which will emit electrons when the filament is heated, such as a nickel wire coated with barium oxide.

Around the cathode filament 22 is an intermediate electrode 26 made of a conductive material, such as iron. The intermediate electrode 26 is secured at its back end to the back wall 14 of the housing 12. The front end 28 of the intermediate electrode 26 is conical and has an opening 30 through its apex which is in alignment with the longitudinal axis of the cathode filament 22. The intermediate electrode 26 has a terminal, not shown, which extends through the back wall 14 of the housing 12 by which the intermediate electrode 26 can be connected to a potential source. A coil 32 of an electromagnet extends around the intermediate electrode 26. The magnet coil 32 has terminals, not shown, extending through the housing 12 to be connected to a source of electrical current.

An anode plate 34 extends across and is secured to the front end of the housing 12. The anode plate 34 is made of a conductive material, such as iron, and is electrically insulated from the outer wall 16 of the housing 12 by an insulator 36. The anode plate 34 has an opening 38 therethrough which is aligned with the opening 30 in the intermediate electrode 26 and the longitudinal axis of the filament cathode 22. A terminal 39 extends from the anode plate 34 to allow the anode plate 34 to be connected across a potential source. The anode plate 34 is also connected to one side of the cathode filament 22 through a circuit 37, such as a resistor circuit, which provides a desired potential difference between the cathode filament 22 and the anode plate 34.

The outer wall 16 of the housing 12 has an inlet opening 40 therethrough which opens into a chamber 42 formed between the intermediate electrode 26 and the anode plate 34. The inlet opening 40 is connected by a pipe 44 to a source 46 of a starting material, which will be explained later. A valve 48 is provided in the pipe 44 to control the flow of the starting material to the chamber 42. A source 50 of an ionizable gas is connected to the inlet opening 40 through a pipe 52. A valve 56 is provided in the pipe 52 to control the flow of the ionizable gas to the chamber 42.

A pipe 64 extends from the outlet opening 20 in the back wall 14 of the housing 12 to a pump 66 for withdrawing gas from the housing 12. A valve 68 is provided in the pipe 64 for controlling the flow through the pipe 64. A pressure gauge 70 is provided in the pipe 64 between the valve 68 and the housing 12, and a second pressure gauge 72 is provided in the pipe 64 adjacent the pump 66. The pipe 64 is made of an electrically non-conducting material, such as polyvinyl chloride.

In the operation of the ion source 10 to achieve a beam of ions, such as helium ions, a current is applied to the cathode filament 22 to heat it to its appropriate temperature, such as 1000° C. A potential of about +20 kV is applied to the anode plate 34. A potential difference is provided between the anode plate 34 and the cathode filament 22 to provide a flow of electrons from the filament 22 to the anode plate 34, typically a potential difference of about 150 volts. The intermediate electrode 26 has applied thereto a potential about one-half that between the cathode filament 22 and the anode plate 34.

A starting gas from the gas source 46 is then admitted into the chamber 42. The starting gas is one which has an ionization probability substantially greater than the gas to be ionized, helium, and which is inert so as not to be deleterious to the material of the cathode filament. Argon has been found to be a suitable gas for the starting gas. However, other inert gases, such as krypton and xenon, may also be used. The valve 48 is opened to allow the starting gas to enter the chamber 42 and, with the pump 66 being on, the valve 68 is opened to draw the starting gas through the opening 30 in the intermediate electrode 26, across the filament 22 and out through the outlet opening 20. The valve 48 is opened until a pressure of about 0.5 torr is indicated by the gauge 70.

The starting gas flowing through the plasma formed between the cathode filament 22 and the anode plate 34 will break down adjacent the intermediate electrode 26 and will create an arc. At this point the valve 56 is opened to allow the ionizing gas, such as pure helium, from the gas source 50 to flow into the chamber 42 and be drawn through the opening 30 in the intermediate electrode 26 and across the cathode filament 22. At the same time the valve 48 can be shut off to cut off the flow of the starting gas. Within a matter of seconds the discharge changes over from the starting gas to the helium, generating the desired helium ions. The helium ions will then be extracted through the opening 38 in the anode plate 34 by the standard extraction electrodes, not shown. The helium gas which is not ionized will pass over the filament 22 and be drawn out of the housing 12 by the pump 66.

It has been found that by using the purest possible helium gas in the vicinity of the opening 38 in the anode plate 34 through which the helium ions are extracted, only helium ions are obtained. If the helium gas contained impurities, ions of other than helium would be generated and extracted from the ion source 12. By passing the helium gas over the filament and withdrawing the excess gas, any impurities which may be generated at the filament are carried away from the filament. This prolongs the useful life of the cathode filament coating and provides filament lifetimes well in excess of 250 hours, more than five times that of previously used ion sources, with no filament failure.

Since the ion source 12 operates at a high potential, about +20 kV, the pipe 64 to the pump 66, which is electrically grounded, must be made of an electrically non-conducting material. In addition, at the pressures existing in the housing 12 during the operation, helium gas is an excellent electrical conductor. Thus, measures must be taken to ensure that the high source potential does not initiate a discharge through the helium within the pipe 64. This is achieved by maintaining a sufficiently low pressure in the pipe by means of the valve 68 and by the pipe dimensions, a pipe which is one inch in diameter and between 8 and 10 feet in length. Thus, the gas inlet valve 56 and the pumping valve 68 are set to maintain the maximum flow of helium gas through the housing 12 while keeping the proper pressure therein for optimum output of helium ions. At the same time, the helium pressure is maintained sufficiently low in the outlet pipe 64 to prevent electrical breakdown of the helium gas within the pipe 64.

We have found that when using pure helium as the ionizing gas, it is very difficult, if not impossible, to start the operation of the ion source 10. The reason is that helium has the lowest ionization probability of any known gas. However, in the ion source 10 of the present invention, ionization is started by means of a starting gas which has an ionization probability greater than that of helium. Argon is a highly suitable gas since it has an ionization probability ten times greater than helium. In addition, it is inert so that it is not deleterious to electron emission of the cathode filament 22. Thus, in the ion source 10 of the present invention the argon is emitted into the housing 12 to start the ionization. Helium is then emitted and the discharge will change from argon to helium. The argon can then be turned off so that only helium is ionized to provide a flow of helium ions from the ion source 10.

Thus, there is provided by the present invention an ion source wherein the ionizing gas is caused to flow over the heated cathode filament and out of the source housing so as to remove impurities formed at the filament. This greatly increases the lifetime of the operation of the filament. Also, the ion source uses highly pure ionizing gas to emit only the desired ions. In addition, the ion source provides for ease of starting the ionization even through the material being used is a highly pure gas of a material having a very low ionization probability, such as helium.

We claim:

1. In an ion beam source which includes within a housing a filament cathode, a means for providing a magnetic filed within said housing, an anode spaced from the cathode and having an opening therethrough, and means for admitting pure helium gas to be ionized into the housing between the anode and the cathode, a means for creating an arc discharge the improvement comprising an outlet opening through the housing on the side of the cathode away from the anode, means for causing a flow of the helium gas over the cathode and out of the housing through said opening and means for providing a flow of a starting gas over the cathode.

2. An ion source in accordance with claim 1 including the source of the helium gas; a source of the starting gas; means connecting each of said sources to the interior of the housing to provide a flow of the gases into the housing; and valve means for controlling the flow of each of the gases into the housing.

3. An ion source in accordance with claim 2 including a separate valve for controlling the flow of each gas into the housing.

4. An ion source in accordance with claim 1 in which the starting gas source is a source of argon.

5. A method of generating ions of a material in an ion source which includes in a housing a cathode and an anode, with the anode having an opening therethrough to emit the ions, the method comprising the steps of providing a magnetic field within said housing heating the cathode, providing a potential difference between the cathode and anode to generate an electron plasma, providing a flow of a starting gas through the housing and over the filament to start an arc discharge, and providing a flow of pure helium gas through the plasma and over the cathode to generate ions of helium with some of the gas flowing out of the housing to remove impurities created at the cathode.

6. A method in accordance with claim 5 in which after the helium gas is admitted into the plasma the flow of the starting gas is stopped.

7. A method in accordance with claim 6 in which the starting gas has an ionization probability greater than that of the helium gas and is inert.

8. A method in accordance with claim 7 in which the starting gas is argon.

* * * * *